United States Patent [19]

Courval

[11] Patent Number: 4,928,508

[45] Date of Patent: May 29, 1990

[54] METHOD OF FORMING PRELUBRICATED FINSTOCK

[75] Inventor: Gregory J. Courval, Napanee, Canada

[73] Assignee: Alcan International Limited, Canada

[21] Appl. No.: 54,522

[22] Filed: May 27, 1987

[30] Foreign Application Priority Data

May 30, 1986 [CA] Canada ..... 510495

[51] Int. Cl.[5] ..... B21D 22/00; B21D 28/00; B21D 53/04

[52] U.S. Cl. ..... 72/42; 29/890.03

[58] Field of Search ..... 72/41, 42, 43, 44, 45; 252/49.5, 49.8, 32.5; 29/157.3 R, 163.5 R, 527.2; 428/395; 118/103, 672

[56] References Cited

U.S. PATENT DOCUMENTS

| | | | |
|---|---|---|---|
| 3,526,596 | 9/1970 | Kress et al. | 252/49.8 |
| 4,177,154 | 12/1979 | Chakrabarti | 72/42 X |
| 4,228,217 | 10/1980 | Baur | 72/42 X |
| 4,388,372 | 6/1983 | Champaneria et al. | 428/395 |
| 4,445,813 | 5/1984 | Misra et al. | 72/42 X |
| 4,452,711 | 6/1984 | Laemmle | 72/42 X |
| 4,559,900 | 12/1985 | Knapke et al. | 118/672 |
| 4,654,155 | 3/1987 | Kipp et al. | 252/32.5 |

FOREIGN PATENT DOCUMENTS

| | | | |
|---|---|---|---|
| 2488676 | 2/1982 | France . | |
| 59-166595 | 9/1984 | Japan | 72/42 |

*Primary Examiner*—E. Michael Combs

[57] ABSTRACT

A prelubricated finstock is described for making heat exchanger fins. The lubricant is water-soluble so that it can be removed from the heat exchanger fins by aqueous means. According to the process, a coating of the water-soluble lubricant is applied to a continuous strip of aluminum alloy finstock. This coating is dried and the coated strip is coiled for shipping and storage. When used, the prelubricated finstock is uncoiled and passed through a finpress to form the heat exchange fins. The lubricant is removed from the fins by aqueous means at any stage after the finpress.

2 Claims, 1 Drawing Sheet

METHOD OF FORMING PRELUBRICATED FINSTOCK

BACKGROUND OF THE INVENTION

This invention relates to prelubricated aluminum strip material and the production of shaped articles, e.g. heat exchanger fins, utilizing such aluminum strip material.

Conventionally, heat exchangers have been constructed with a very narrow fin spacing in order to provide a design in which the surface areas of the heat radiating part and the cooling part are as large as possible. The condensation of water droplets on the fins tends to interfere with air flow and, accordingly, it has been necessary to provide hydrophilic coatings on the fins which make possible very rapid removal of any water that condenses on the fins. One known method of rendering the fins hydrophilic is the Boehmiting process.

The heat exchanger fins are formed from a finstock. This is typically an aluminum material which is formed into the fins by passing through a finpress die.

At present, most finstock is flooded with lubricating oil prior to feeding into a finpress. As a result, the environment of the finpress is oily and most unpleasant and, moreover, the fins must be degreased after forming. The most commonly used organic solvent for this purpose is trichloroethylene. The use of organic solvents, such as trichloroethylene, for degreasing poses various problems, such as: (1) health hazards, (2) odour, (3) fire hazards and (4) the problem of handling and disposing of oil/solvent mixtures.

Many of the above problems can be eliminated by the use of prelubricated finstock, since the finstock user then no longer needs to apply any lubricating oil prior to forming. Within the past few years, the use of "evaporative" lubricating oils has been promoted as a means of eliminating the degreasing procedure. These evaporative oils are very dilute (approximately 10%) solutions of lubricating oil in mineral spirits. After forming, the mineral spirits evaporate from the fins, thereby eliminating the need for degreasing. However, residual oil remains on the fin surfaces. While this residual oil does not present any problems in handling of the fins, when heat exchangers, such as evaporators, are constructed using these fins, the residual oil can interfere with hydrophilic treating processes such as the Boehmiting process.

SUMMARY OF THE INVENTION

In accordance with the present invention, the above difficulties are substantially eliminated by prelubricating an aluminum strip material, e.g. finstock, with a water-soluble lubricant. This means that any residual lubricant can easily be removed from a shaped product, such as a heat exchanger, by aqueous means, such as spraying with water or immersing in water. If the heat exchanger is being treated in an aqueous system, such as Boehmiting, no separate removal of the lubricant is necessary and it will quickly dissolve during the Boehmiting process while immersed in water.

In a typical procedure, the water soluble lubricant is applied as a coating to a continuous strip of aluminum material, and the strip is coiled. The coated coil can then be stored and used when required. When used, the coated strip is uncoiled and fed to a forming device, such as finpress, to form heat exchanger fins. Thereafter, the lubricant can be removed from the fins by aqueous means at any processing stage.

A typical finstock is an aluminum alloy containing as alloying elements small amounts of silicon, iron, copper, manganese and zinc. Common finstock alloys are those having the AA (Aluminum Association) designations 1100 and 7072 and the finstock typically has a thickness of about 75 to 150 microns.

In order to be suitable for the present invention, the water-soluble lubricant must have a high viscosity and be non-sticky. It must also be abrasion resistant so that the finpress dies are not damaged during the forming process. A typical water-soluble lubricant has a solubility of at least 50 gpl and a viscosity of at least 50 mPas. Most finstocks achieve an Olsen cup reading in the range of 0.26 to 0.30 for bare metal. This is generally unsuitable for forming and a lubricant is required. The lubricated finstock should achieve an Olsen cup reading of greater than 0.30 and preferably 0.34. It should also have a low volatility and have a shelf life of at least six months. A particularly preferred lubricant has a solubility of about 200 gpl and a viscosity of 1000 mPas.

Many different water-soluble agents can meet the above requirements. For instance, there may be used polyethylene glycol dioleate esters, ethoxylated fatty acids such as ethoxylated castor oil and ethoxylated stearic acid, quaternary ammonium polymers, etc.

The water soluble lubricant is typically applied to a continuous strip of finstock from a diluted solution, e.g. by passing the finstock strip through a bath of the solution, removing excess solution by squeege rolls and passing the strip through a drying oven to remove diluent. The lubricant is typically present on the finstock in an amount of about 50 to 1,000 mg/m$^2$. Preferably, at least 200 mg/m$^2$ of lubricant is used, with at least 500 mg/m$^2$ being particularly preferred. After application of the water-soluble lubricant, the finstock is coiled for shipping and storage and subsequently uncoiled for feeding to a finpress. The lubricant can be removed by aqueous means at any stage subsequent to the finpress.

An important advantage of this invention is that it eliminates the need to apply oil to the finstock prior to forming in the finpress, which resulted in an oily work environment. When the prelubricated finstock of this invention is used, the process is dry.

BRIEF DESCRIPTION OF THE DRAWING

FIGS. 1A through 1D are photomicrographs of ball bearings used in the abrasion test described in Example 2(*a*) below, wherein FIG. 1A shows an untested ball bearing, FIG. 1B shows a ball bearing after performing the abrasion test with Alkasurf CO-40 lubricant, FIG. 1C shows a ball bearing after performing the abrasion test with Oak 70-1 evaporative oil, and FIG. 1D shows a ball bearing after performing the abrasion test with Oak 7A oil.

DETAILED DESCRIPTION

Figure 1A:
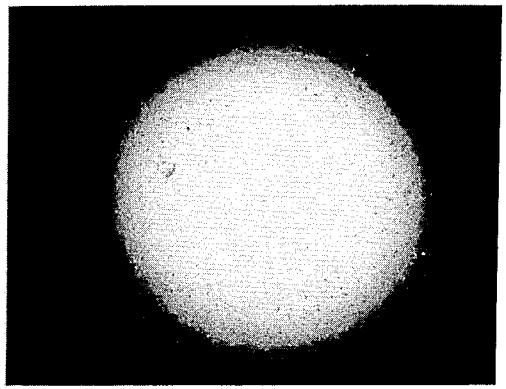

The present invention will be more readily apparent from consideration of the following illustrative examples.

EXAMPLE 1

The primary requirement of a finstock lubricant is that it provides sufficient lubricity to the fins while being formed. Accordingly, a variety of lubricants were tested for their lubricating ability using a ball punch deformation test. This test method is described in ASTM E-643-78 and is more commonly known as the Olsen cup test. Briefly, the test involves pushing a punch through a test coupon at a fixed rate. Deformation of the coupon is measured until first rupture. The better the lubrication, the greater the deformation will be before rupture occurs. Therefore, a larger Olsen cup reading indicates a better lubricant.

A series of tests were carried out on samples of Alcan 8007-H22 aluminum having a gauge of 150 microns. These were coated with a variety of water-soluble agents, a typical Oak Chemical Company finpress oil and an Oak evaporative oil. The coatings were applied by passing the aluminum through a diluted solution bath of lubricating agent and drying to remove diluent. The coated samples with a lubricant level of about 50–1000 mg/m$^2$ were then subjected to the Olsen cup test. The results are shown in Table 1 below.

TABLE 1

BALL PUNCH DEFORMATION (OLSEN CUP) TEST (READINGS IN INCHES)

| LOADING:MG/M$^2$ | 50 | 200 | 500 | 1000 | Rating |
|---|---|---|---|---|---|
| LUBRICANT | | | | | |
| (1)MAUAT 1416 | 0.299 | 0.301 | 0.347 | 0.330 | C |
| (2)MAQUAT SC-1632 | 0.298 | 0.306 | 0.326 | 0.332 | C |
| (2)MAQUAT SC-18 | 0.296 | 0.307 | 0.286 | 0.292 | E |
| (3)ALKASURF 400-DO | 0.294 | 0.306 | 0.344 | 0.336 | B |
| (4)ALKASURF CO-40 | 0.299 | 0.302 | 0.340 | 0.347 | A |
| (4)ALKASURF CO-15 | 0.296 | 0.304 | 0.338 | 0.341 | A |
| (5)ALKASURF 600-DO | 0.301 | 0.307 | 0.335 | 0.340 | B |
| (6)ALKASURF S-65-8 | 0.294 | 0.302 | 0.294 | 0.326 | C |
| (7)PEG 3350 | 0.303 | 0.309 | 0.298 | 0.281 | F |
| (8)DRIFORM 62A | 0.259 | 0.270 | 0.244 | 0.250 | G |
| (8)DRIFORM 515 | 0.221 | 0.265 | 0.291 | 0.277 | G |
| (9)CORTEC VCI317 | | | 0.294* | | E |
| (10)OAK 7A Fin Press Oil | | | 0.308* | | |
| (10)OAK 70-1 Evap. Oil | | | 0.266 | | |
| BARE METAL** | | | 0.275 | | |

*Avg. of variable values
**Cleaned with methyl ethyl ketone
(1)Trademark of Mason Chemical Company for N-alkyl diethylbenzyl ammonium chloride
(2)Trademark of Mason Chemical Company for quaternary ammmonium polymer
(3)Trademark of Alkaril Chemical Limited for PEG 400-dioleate ester
(4)Trademark of Alkaril Chemical Limited for ethoxylated castor oil
(5)Trademark of Alkaril Chemical Limited for PEG 600-dioleate ester
(6)Trademark of Alkaril Chemical Limited for ethoxylated stearic acid
(7)Union Carbide Corporation
(8)Trademark of Steetley Minerals Limited for lubricating agent and resin
(9)Trademark of Cortec Corporation for anionic polymer
(10)Trademark of Oak International Chemical Lubricants having a rating of A-D are considered to be satisfactory, with those having a rating of A being the best. It will be seen that several of the water-soluble agents gave higher Olsen cup readings than either the standard Oak finpress oil or the newer Oak evaporative oil. Particularly good results were obtained with ethoxylated castor oil.

EXAMPLE 2

Further tests were conducted to compare Alkasurf CO-40 with the previously known Oak A7 oil and Oak 70-1 evaporative oil. A finstock was passed through a solution bath containing 20% of the Alkasurf CO-40 in isopropanol. Excess lubricating solution was removed by squeege rolls and the coated aluminum was then passed through a drying oven to remove isopropanol. The coated metal had a lubricant level in the range of 600–800 mg/m$^2$.

(a) Abrasion Test

Formability is clearly the most important property provided to metal by a lubricant. However, the lubricant must also provide a certain degree of abrasion resistance so that the finpress dies are not damaged during the forming operation. Abrasion testing of Alkasurf CO-40, Oak A7 oil and Oak 70-1 evaporative oil was carried out on a pin-on-disc abrasion tester. This device applies a set loading (220 g) onto a pin which has a stainless steel ball bearing (3 mm diameter) at the tip. The pin rests on a disc made from a lubricated test coupon. The disc is rotated at a set speed (40 rpm) for a set period (20 minutes). The pin is attached to an arm which moves across the disc as the disc rotates to cover a wide area of the disc. At the end of the experiment, the ball bearing is examined under a microscope to determine the degree of abrasion that has occurred.

Figure 1B:
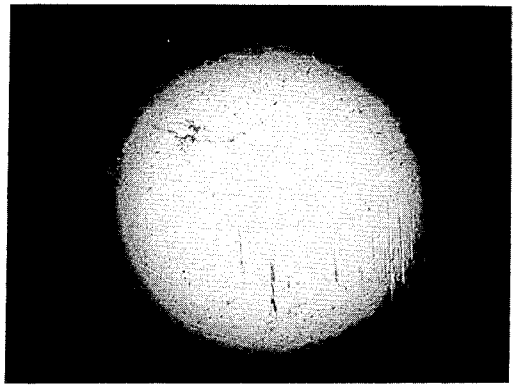
Figure 1C:
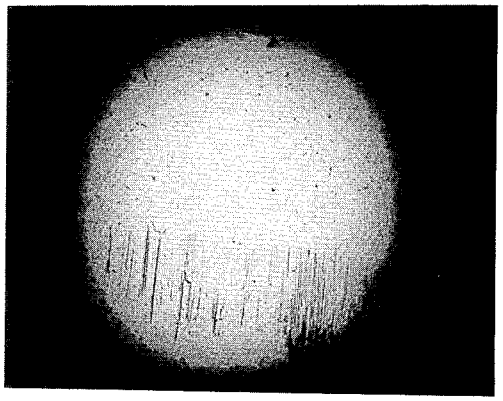
Figure 1D:
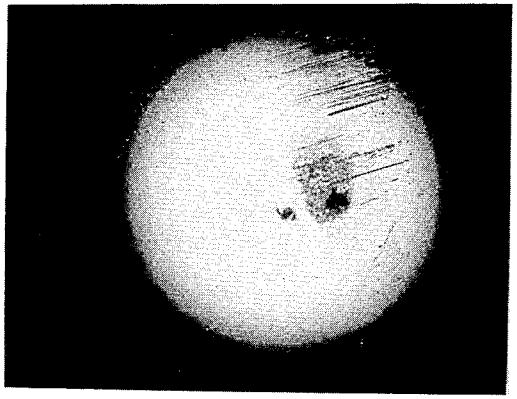

Photomicrographs of the results are shown in FIGS. 1A, 1B, 1C, and 1D. All experiments were carried out at 500 mg/m$^2$ lubricant level on test coupons. A comparison of an untested ball bearing with the abrasion on the ball bearing from the Alkasurf CO-40 sample and the Oak oil samples clearly shows that the Alkasurf CO-40 provides at least as good abrasion protection for the finpress dies as does the known Oak oils.

(b) Temperature Resistance

Return bends are often flame brazed onto heat exchangers after the fin-tube assembly has been completed. A test was, therefore, conducted to determine the effect of exposure of prelubricated finstock to short periods of high temperatures. Five test finstock coupons coated with 1,000 mg/m$^2$ Alkasurf CO-40 lubricant were placed in a circulating air oven at 400° C. for 1 minute to simulate internal fin exposure conditions. A slight odour was detected but no smoking was observed. The percentage weight loss of lubricant ranged from 3 to 10%.

(c) Solubility of Lubricant in Mineral Spirits

A build-up of metal chips occurs around the finpress during the forming operation. The flooded lubricating process normally washes away these chips. With prelubricated finstock, however, an alternative process for removing these chips is required. An air jet can be positioned to blow away metal chips from the die area, or the prelubricated finstock can be washed with a solvent in which the lubricant is not soluble. To determine the suitability of aliphatic minerals spirits as a solvent for this purpose, five finstock coupons with known levels of Alkasurf CO-40 lubricant were placed in a bath of mineral spirits and agitated by hand for one minute. Samples were then flushed with mineral spirits from a squeeze bottle and finally the samples were allowed to dry and reweighed. The percentage of Alkasurf CO-40 removed varied from 0.8 to 6.0%. This clearly established that flushing with mineral spirits is a suitable method for removing metal chips from prelubricated finstock.

(d) Cloudiness in Aqueous Solutions

Evaporators and condensors are generally tested for leaks by immersion in a water bath. Water soluble lubricants on prelubricated finstock will dissolve in these baths because of their water solubility. However, the water baths must remain transparent so that the immersed heat exchanger can be observed. To determine the cloudiness of Alkasurf CO-40 aqueous solutions, a series of solutions with concentrations ranging up to 200 g/l Alkasurf CO-40 were prepared. Turbidity was measured on a HACH Turbidmeter and these measurements were compared to standard turbidity units of 18 NTU (very slightly cloudy) to 100 NTU (cloudy). The 200 g/l Alkasurf CO-40 solution had a reading of only 5 NTU and showed no cloudiness. Only a slight yellow colour was observed. Thus, Alkasurf CO-40 presents no problems of clouding for tank tests.

I claim:

1. A process which comprises: (a) forming a coating of water soluble lubricant on a continuous strip of aluminum alloy finstock having a thickness of 75 to 150 microns, said lubricant having a solubility of at least 50 gpl and a viscosity of at least 50 mPas, and coiling the coated strip to form a prelubricated coil having an Olsen cup rating of greater than 0.30, (b) subsequently uncoiling the prelubricated coil and passing the coated strip through a forming device to form aluminum alloy heat exchange fins, and (c) thereafter removing the lubricant from the heat exchange fins by applying an aqueous medium thereto.

2. The process according to claim 1 wherein the lubricant is ethoxylated castor oil.

* * * * *